US008887490B2

(12) United States Patent
Wentz et al.

(10) Patent No.: US 8,887,490 B2
(45) Date of Patent: Nov. 18, 2014

(54) RICH BURN INTERNAL COMBUSTION ENGINE CATALYST CONTROL

(71) Applicant: General Electric Company, Schenectady, NY (US)

(72) Inventors: Jared J. Wentz, Wauwatosa, WI (US); Pin Zeng, Vernon Hills, IL (US); Ryan Michael Rudnitzki, Milwaukee, WI (US)

(73) Assignee: General Electric Company, Schenectady, NY (US)

( * ) Notice: Subject to any disclaimer, the term of this patent is extended or adjusted under 35 U.S.C. 154(b) by 17 days.

(21) Appl. No.: 13/760,630

(22) Filed: Feb. 6, 2013

(65) Prior Publication Data

US 2014/0216009 A1 Aug. 7, 2014

(51) Int. Cl.

| | |
|---|---|
| ***F01N 3/00*** | (2006.01) |
| ***F01N 3/10*** | (2006.01) |
| ***F01N 3/20*** | (2006.01) |
| ***F02D 41/14*** | (2006.01) |

(52) U.S. Cl.

CPC ..... *F01N 3/20* (2013.01); *F02D 41/1452* (2013.01); *F02D 41/1454* (2013.01); *F02D 41/146* (2013.01)

USPC ..... 60/285; 60/274; 60/276; 60/299

(58) Field of Classification Search

USPC ..... 60/274, 276, 285, 299, 301

See application file for complete search history.

(56) References Cited

U.S. PATENT DOCUMENTS

| | | | | |
|---|---|---|---|---|
| 4,492,559 | A | 1/1985 | Pocock | |
| 5,390,490 | A * | 2/1995 | Brooks | 60/276 |
| 6,256,983 | B1 * | 7/2001 | Yasui | 60/285 |
| 2006/0021330 | A1 * | 2/2006 | Midlam-Mohler et al. | 60/285 |
| 2013/0074817 | A1 | 3/2013 | Fisher et al. | |
| 2013/0138326 | A1 * | 5/2013 | Andersson | 701/103 |
| 2013/0151125 | A1 | 6/2013 | Mann | |

FOREIGN PATENT DOCUMENTS

JP 0815917 A 1/1996

* cited by examiner

*Primary Examiner* — Audrey K Bradley
(74) *Attorney, Agent, or Firm* — Fletcher Yoder, P.C.

(57) ABSTRACT

A catalyst system may include a catalyst and a first sensor that detects contents of gases entering the catalyst and reports the contents of the gases entering the catalyst to an emissions control module. A second sensor and a third sensor may detect contents of gases exiting the catalyst and report the contents of the gases exiting the catalyst to the emissions control module. The emissions control module may determine an air-fuel ratio based on the contents of gases entering the catalyst and the contents of gases exiting the catalyst. The emissions control module may instruct an air-fuel regulator to operate an engine using the air-fuel ratio.

12 Claims, 5 Drawing Sheets

RICH BURN INTERNAL COMBUSTION ENGINE CATALYST CONTROL

TECHNICAL FIELD

The present disclosure relates to emissions controls for internal combustion engines generally and in particular to methods and systems for catalyst control in rich burn engines.

BACKGROUND

Internal combustion engines are ideally operated in a way that the combustion mixture contains air and fuel in the exact relative proportions required for a stoichiometric combustion reaction (i.e., where the fuel is burned completely.) A rich-burn engine may operate with a stoichiometric amount of fuel or a slight excess of fuel, while a lean-burn engine operates with an excess of oxygen ($O_2$) compared to the amount required for stoichiometric combustion. The operation of an internal combustion engine in lean mode may reduce throttling losses and may take advantage of higher compression ratios thereby providing improvements in performance and efficiency. Rich burn engines have the benefits of being relatively simple, reliable, stable, and adapt well to changing loads. Rich burn engines may also have lower nitrogen oxide emissions, but at the expense of increased emissions of other compounds.

In order to comply with emissions standards, many rich burn internal combustion engines utilize catalysts, such as non-selective catalytic reduction (NSCR) subsystems (known as 3-way catalysts). Catalysts may reduce emissions of nitrogen oxides such as nitric oxide (NO) and nitrogen dioxide ($NO_2$) (collectively NOx), carbon monoxide (CO), ammonia ($NH_3$), methane ($CH_4$), other volatile organic compounds (VOC), and other compounds and emissions components by converting such emissions components to less toxic substances. This conversion is performed in a catalyst component using catalyzed chemical reactions. Catalysts can have high reduction efficiencies and can provide an economical means of meeting emissions standards (often expressed in terms of grams of emissions per brake horsepower hour (g/bhp-hr)).

In order to achieve low CO and NOx emissions levels, a catalyst must be operated within a relatively narrow operating window that corresponds to a range of air/fuel mixtures. However, the operating window for optimal CO and NOx emissions levels varies in size and location over time as operating conditions at the engine vary. For example, as the environment in which the engine is operated changes (e.g., temperature of area surrounding the engine rises or falls, moisture in the air surrounding the engine increases or decreases, etc.), the operating window may become more narrow or broad and/or drift such that the air/fuel ratios that allow the engine to maintain low CO and NOx emissions levels (e.g., levels below Environmental Protection Agency (EPA) limits) may change. Similarly, as the engine operating conditions change (e.g., temperature of engine rises or falls, quality of fuel changes, etc.), the operating window may become more narrow or broad and/or drift such that the air/fuel ratios that allow the engine to maintain low CO and NOx emissions levels may change. In the current state of the art, regular manual adjustment of the air/fuel ratio for an engine is required in order to ensure that the engine is maintaining low CO and NOx emissions levels.

BRIEF DESCRIPTION OF THE INVENTION

In an exemplary non-limiting embodiment, a catalyst system may include a catalyst and a first sensor that detects contents of gases entering the catalyst and reports the contents of the gases entering the catalyst to an emissions control module. A second sensor and a third sensor may detect contents of gases exiting the catalyst and report the contents of the gases exiting the catalyst to the emissions control module. The emissions control module may determine an air-fuel ratio based on the contents of gases entering the catalyst and the contents of gases exiting the catalyst. The emissions control module may instruct an air-fuel regulator to operate an engine using the air-fuel ratio.

In another exemplary non-limiting embodiment, a method is disclosed for receiving data indicating contents of gases entering a catalyst from a first sensor at an emissions control module. Data may also be received at the emissions control module from a second sensor and a third sensor indicating contents of gases exiting the catalyst. An air-fuel ratio may be determined by the emissions control module based on the contents of the gases entering the catalyst and the contents of the gases exiting the catalyst. Instructions may be transmitted to an air-fuel regulator to operate an engine using the air-fuel ratio.

The foregoing summary, as well as the following detailed description, is better understood when read in conjunction with the drawings. For the purpose of illustrating the claimed subject matter, there is shown in the drawings examples that illustrate various embodiments; however, the invention is not limited to the specific systems and methods disclosed.

BRIEF DESCRIPTION OF THE DRAWINGS

These and other features, aspects, and advantages of the present subject matter will become better understood when the following detailed description is read with reference to the accompanying drawings, wherein.

DETAILED DESCRIPTION OF THE INVENTION

Figure 1:
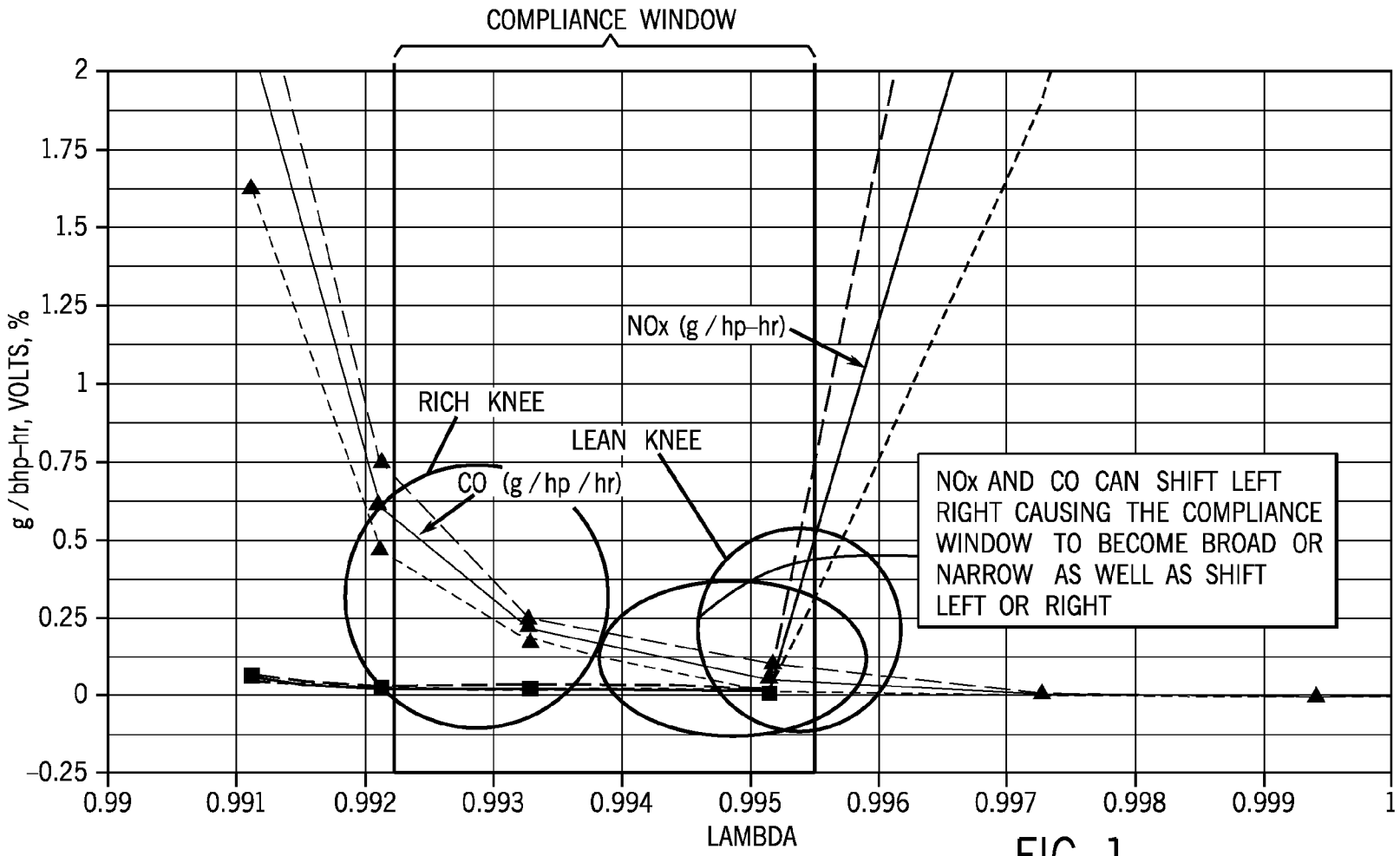
FIG. 1 is an exemplary chart illustrating a catalyst operating window and related data.

FIG. 1 is a chart illustrating example CO and NOx emissions curves relative to lambda ($\lambda$). As one skilled in the art will recognize, lambda is the air-fuel equivalence ratio (actual air-fuel ratio/stoichiometric air-fuel ratio). NOx and CO concentrations are not linear, but rather changed dramatically as the "knee" of each of the respective curve representing the concentration of NOx and CO is approached. In this example, as shown in FIG. 1, the g/bhp-hr of NOx emitted may increase at a much greater rate as lambda surpasses 0.995 and approaches 0.996, while the g/bhp-hr of CO emitted may increase at a much greater rate as lambda declines below 0994 and retreats towards 0.993. This chart also shows the compliance window, or operating window, in which CO and NOx emissions are below desired levels. The range of lambda in this window is dependent on the current NOx and CO emission levels. However, as conditions change in the engine and/or the environment in which the engine is operating, NOx and CO emissions levels for any particular lambda may change, and therefore the operating window may change in size and location relative to lambda. Thus, as NOx and CO emissions levels change for an engine operating with a particular air-fuel ratio, the air-fuel ratio may need to be adjusted to ensure that the engine maintains low emissions levels. Note that this chart is presented as a demonstrative aide only to illustrate the problem solved by the current disclosure. No limitation on the present subject matter is to be construed from the chart in FIG. 1.

Figure 2:
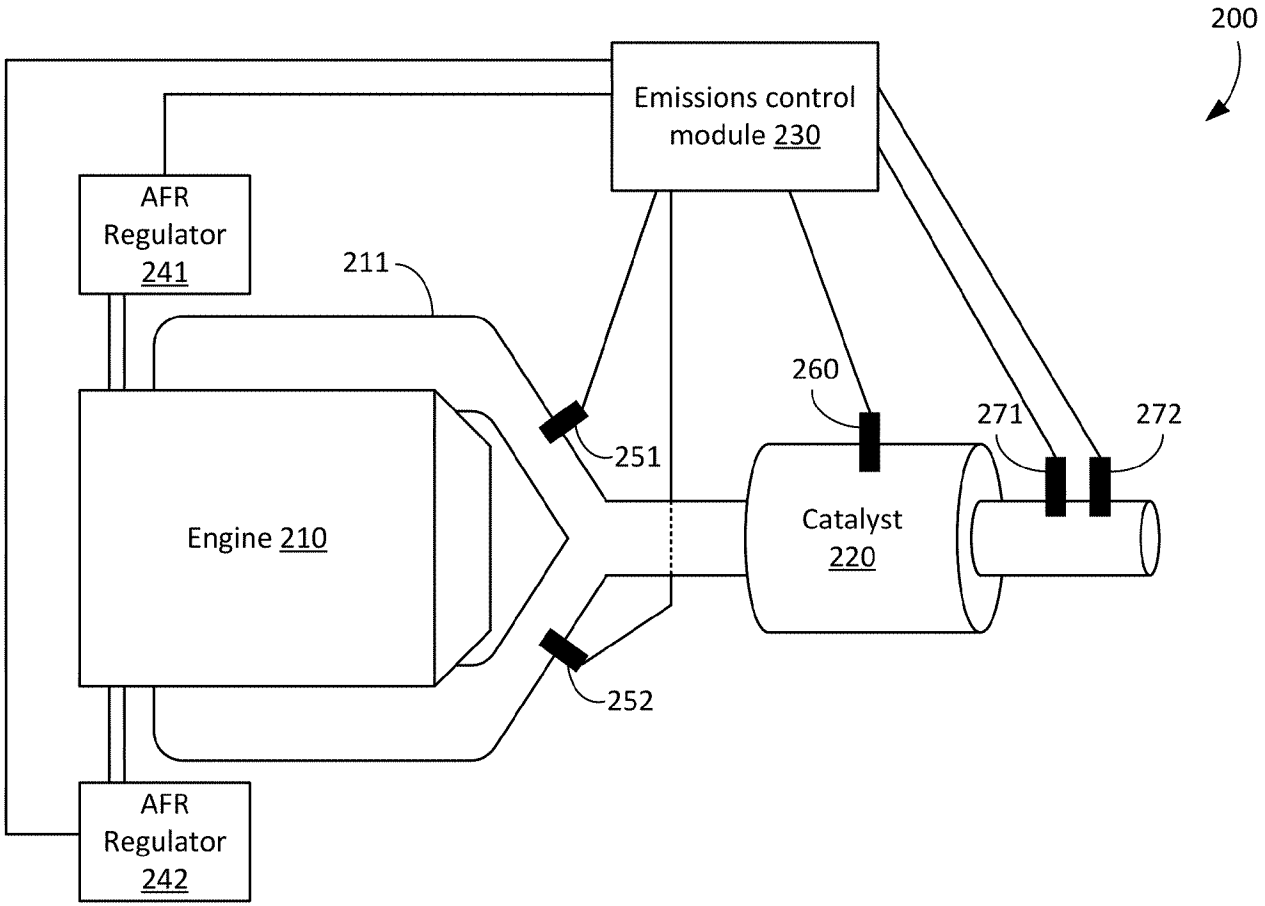
FIG. 2 is a block diagram of a non-limiting exemplary rich-burn engine and catalyst system.

FIG. 2 illustrates exemplary system 200, including engine 210 and catalyst 220, that may be implemented according to an embodiment. Note that the entirely of system 200 may also be referred to as an "engine". System 200 is a simplified block diagram that will be used to explain the concepts disclosed herein, and therefore is not to be construed as setting forth any physical requirements or particular configuration required for any embodiment disclosed herein. All components, devices, systems and methods described herein may be implemented with or take any shape, form, type, or number of components, and any combination of any such components that are capable of implementing the disclosed embodiments. All such embodiments are contemplated as within the scope of the present disclosure.

Engine 210 may be any type of internal combustion engine or any device, component, or system that includes an internal combustion component that generates exhaust gases. In an embodiment, engine 210 may be a natural gas fueled internal combustion engine configured to operate with a stoichiometric amount of fuel or a slight excess of fuel in proportion to oxygen (i.e., rich). However, the disclosed embodiments are not limited to such an engine, and may be used with any type of stationary or mobile internal combustion engine. Engine 210 may exhaust gases through exhaust piping 211 into catalyst 220 which then exhausts converted exhaust gases. Catalyst 220 represents one or more catalysts of any type, and any combination of any types of catalysts.

In an embodiment, rather than requiring manual adjustment of the air-fuel mixture to ensure that low emissions are maintained, sensors may be used at various points along the exhaust flow to collect data regarding the content of exhaust gases. The collected data may be provided to emissions control module 230, which may be any type of device, component, computer, or combination thereof, that may be configured to determine an appropriate air-fuel mixture based on the level of one or more compounds in exhaust gases. Emissions control module 230 may, upon determining the optimal air-fuel mixture or an appropriate adjustment in the air-fuel mixture, transmit instructions to or otherwise control air-fuel regulators 241 and 242 so that air-fuel regulators 241 and 242 cause the correct air-fuel mixture to be sent to engine 210. Each of air-fuel regulators 241 and 242 may be a fuel system, carburetor, fuel injector, fuel pass regulator, any system including one or more of these, or any combination thereof.

In an embodiment, system 200 may include pre-catalyst sensors, mid-catalyst sensors, and post-catalyst sensors. In this embodiment, post-catalyst sensor 271 may be an oxygen (e.g., $O_2$) sensor and post-catalyst sensor 272 may be a NOx sensor. Post-catalyst sensor 272 may also, or instead, be a CO sensor. Post-catalyst sensor 271 may feed data reflecting detected levels of oxygen to emissions control module 230 and post-catalyst sensor 272 may feed data reflecting detected levels of NOx and/or CO to emissions control module 230. Post-catalyst sensors 271 and/or 272 may sense overall catalyst efficiency, but may be relatively slow to report changes in the composition of exhaust gases to emissions control module 230 because it senses the gases only after they have been through the entire catalyst system used by engine 210.

Mid-catalyst sensor 260 may be configured within any one catalyst brick within catalyst 220, or may be any number of sensors configured in any number of catalyst bricks within catalyst 220. Alternatively, mid-catalyst sensor 260 may be configured between two catalyst bricks within catalyst 220, or may configured between two separate catalysts, each of which having one or more catalyst bricks. Note that catalyst 220 represents any number of individual catalysts of any type having any number of catalyst bricks, and mid-catalyst sensor 260 represents any number and type of sensors that may be configured to detect any type of content within a catalyst. All such variations are contemplated as within the scope of the present disclosure. Mid-catalyst sensor 260 may be an oxygen (e.g., $O_2$) sensor and may provide an indication of the efficiency of catalyst 220, reporting changes in exhaust gases to emissions control module 230 more rapidly than post-catalyst sensors 271 and 271 as mid-catalyst sensor 260 is configured to detect the level of oxygen at catalyst 220. Pre-catalyst sensors 251 and 252 may be oxygen (e.g., $O_2$) sensors and due to their location may react the fastest among the sensors as they will sense and report to emissions control module 230 the content of exhaust gas as it is emitted from engine 210 and before it travels into catalyst 220.

Using the data received from one or more of post-catalyst sensors 271 and 271, mid-catalyst sensor 260, and pre-catalyst sensors 251 and 252, emissions control module 230 may determine an appropriate air-fuel mixture and transmit data indicating the determined air-fuel mixture or otherwise instruct air-fuel regulators 241 and 242 to operate engine 210 using the determined air-fuel mixture.

In one embodiment, emissions control module 230 may determine an air-fuel mixture set point based on data from pre-catalyst sensors 251 and 252, and then may modify that set point to determine a second set point based on data from mid-catalyst sensor 260. The second set point may then be further modified based on data from post-catalyst sensors 271 and 272.

Figure 3:
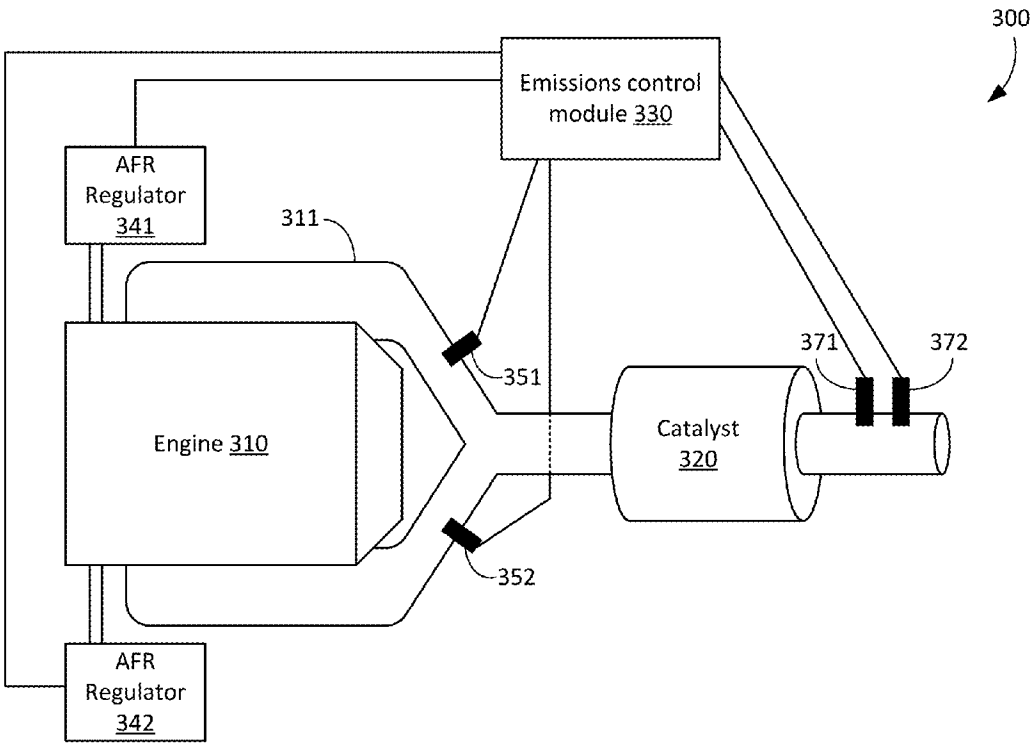
FIG. 3 is a block diagram of another non-limiting exemplary rich-burn engine and catalyst system.

FIG. 3 illustrates exemplary system 300, including engine 310 and catalyst 320, that may be implemented according to an embodiment. Note that the entirely of system 300 may also be referred to as an "engine". System 300 is a simplified block diagram that will be used to explain the concepts disclosed herein, and therefore is not to be construed as setting forth any physical requirements or particular configuration required for any embodiment disclosed herein. All components, devices, systems and methods described herein may be implemented with or take any shape, form, type, or number of components, and any combination of any such components that are capable of implementing the disclosed embodiments. All such embodiments are contemplated as within the scope of the present disclosure.

Engine 310 may be any type of internal combustion engine or any device, component, or system that includes an internal combustion component that generates exhaust gases. In an embodiment, engine 310 may be a natural gas fueled internal combustion engine configured to operate with a stoichiometric amount of fuel or a slight excess of fuel in proportion to oxygen (i.e., rich). However, the disclosed embodiments are not limited to such an engine, and may be used with any type of stationary or mobile internal combustion engine. Engine 310 may exhaust gases through exhaust piping 311 into catalyst 320 which then exhausts converted exhaust gases. Catalyst 320 represents one or more catalysts of any type, and any combination of any types of catalysts.

In this embodiment, fewer sensors may be used to accomplish the same goals of automating efficient catalyst control. Specifically, in FIG. 3, there is no mid-catalyst sensor. Data collected from post-catalyst sensors 371 and 372 and pre-catalyst sensors 351 and 352 may be provided to emissions control module 330, which may be any type of device, component, computer, or combination thereof, that is configured to determine an appropriate air-fuel mixture based on the level of one or more compounds in exhaust gases. Emissions control module 330 may, upon determining the optimal air-fuel mixture or an appropriate adjustment in the air-fuel mixture, transmit instructions to or otherwise control air-fuel regulators 341 and 342 so that air-fuel regulators 341 and 342 cause the correct air-fuel mixture to be sent to engine 310. Each of air-fuel regulators 341 and 3242 may be a fuel system, carburetor, fuel injector, fuel pass regulator, any system including one or more of these, or any combination thereof.

In this embodiment, post-catalyst sensor 371 may be an oxygen (e.g., $O_2$) sensor and post-catalyst sensor 372 may be a NOx sensor. Post-catalyst sensor 372 may also, or instead, be a CO sensor. Post-catalyst sensor 371 may feed data reflecting detected levels of oxygen to emissions control module 330 and post-catalyst sensor 372 may feed data reflecting detected levels of NOx and/or CO to emissions control module 330. Post-catalyst sensors 371 and/or 372 may sense overall catalyst efficiency, but may be relatively slow to report changes in the composition of exhaust gases to emissions control module 330 because it senses the gases only after they have been through the entire catalyst system used by engine 310. Pre-catalyst sensors 351 and 352 may be oxygen (e.g., $O_2$) sensors and due to their location may react the fastest among the sensors as they will sense and report to emissions control module 330 the content of exhaust gas as it is emitted from engine 310 and before it travels into catalyst 320.

Using the data received from one or more of post-catalyst sensors 371 and 372 and pre-catalyst sensors 351 and 352, emissions control module 330 may determine an appropriate air-fuel mixture and transmit data indicating the determined air-fuel mixture or otherwise instruct air-fuel regulators 341 and 342 to operate engine 310 using the determined air-fuel mixture.

In one embodiment, emissions control module 330 may determine an air-fuel mixture set point based on data from pre-catalyst sensors 351 and 352, and then may modify that set point to determine a second set point based on data from post-catalyst sensors 371 and 372.

In an embodiment, an initial post-catalyst $O_2$ set-point level may be determined and loaded into a bias table stored at, or accessible by, emissions control module 330. Based on the bias table, emissions control module 330 may modify the pre-catalyst $O_2$ air-fuel ratio set-point as the post-catalyst $O_2$ levels change. In this embodiment, emissions control module 330 may determine the catalyst operating window (an example of which is shown in FIG. 1) through a sub-routine and set the determined air-fuel ratio set-point as a zero (0) bias point. Emissions control module 330 may then modify the pre-catalyst $O_2$ set-point as the post-catalyst $O_2$ level moves. The post-catalyst NOx sensor may be used in determining the initial set-point and in modifying the post-catalyst $O_2$ set-point bias table up and down as NOx levels change.

In an embodiment, emissions control module 330 may be configured with a predetermined emissions compliance level and/or catalyst efficiency. In such an embodiment, preconfigured NOx and/or CO grams level may be set and, upon detection of one or both of these levels being approached, met, and/or exceeded, a user may be notified of the out-of-compliance condition and/or a shutdown of the engine may be performed automatically by emissions control module 330. In some embodiments, catalyst efficiency may be based on a determined amount of modification of pre-catalyst $O_2$ set-points and/or other conditions, such as engine operating hours and load and monitored environmental conditions.

Any system or engine described herein may be operated to achieve an optimum $O_2$ set-point for NOx and CO compliance. For example, one or more NOx sensors as described herein may be used to determine a CO concentration that may be represented as an increase in the NOx parts-per-million (ppm) output as the rich knee of the lambda curve (see FIG. 1) is approached. The increasing CO concentration when an air-fuel mixture is rich may create stable interference in a NOx sensor, where a NOx reading from such a sensor may indicate a higher level of NOx concentration where actually ammonia is being detected. In a lean air-fuel ratio, such a sensor may read similar levels of NOx as normal. Ammonia created at extremely rich air-fuel ratios may be reported as NOx concentration by a NOx sensor.

Figure 4:
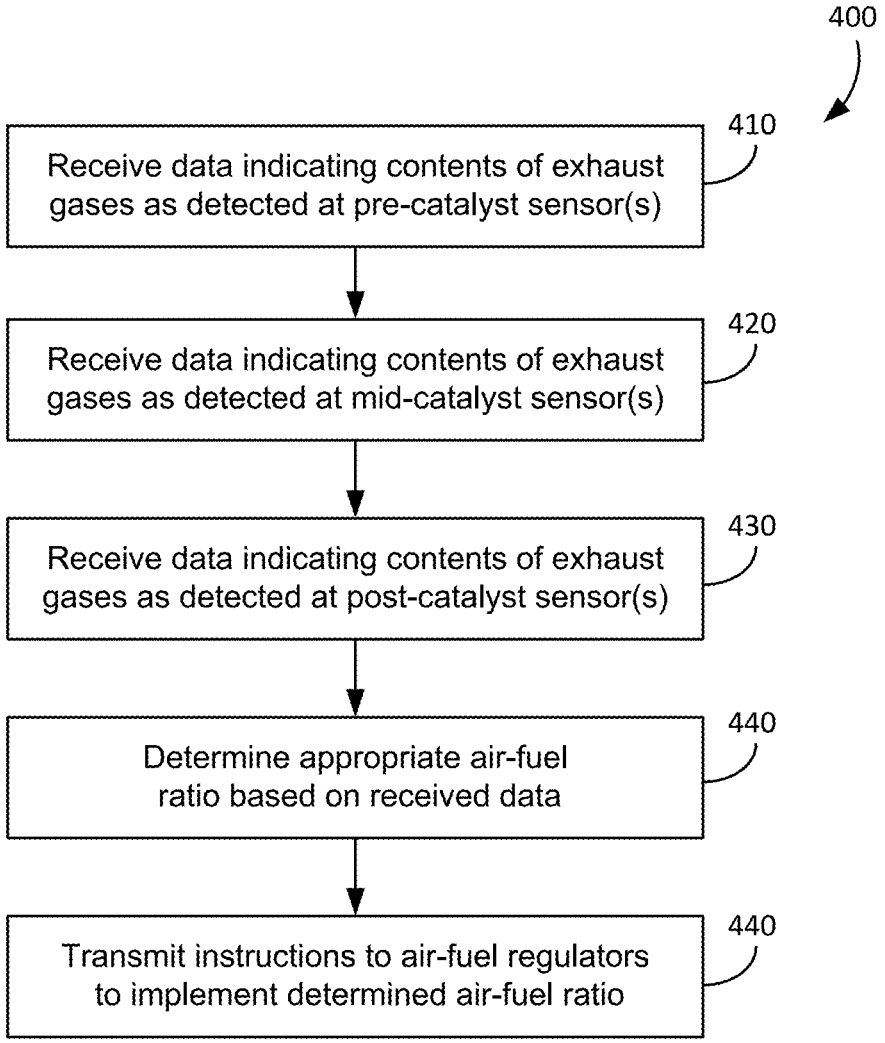
FIG. 4 is a flowchart of a non-limiting exemplary method of implementing a rich-burn engine and catalyst system according to the present disclosure.

FIG. 4 illustrates exemplary, non-limiting method 400 of implementing an embodiment as disclosed herein. Method 400, and the individual actions and functions described in method 400, may be performed by any one or more devices or components, including those described herein, such as the systems illustrated in FIGS. 1 and 2. In an embodiment, method 400 may be performed by any other devices, components, or combinations thereof, in some embodiments in conjunction with other systems, devices and/or components. Note that any of the functions and/or actions described in regard to any of the blocks of method 400 may be performed in any order, in isolation, with a subset of other functions and/or actions described in regard to any of the other blocks of method 400 or any other method described herein, and in combination with other functions and/or actions, including those described herein and those not set forth herein. All such embodiments are contemplated as within the scope of the present disclosure.

At block 410, data may be received at an emissions control module from one or more pre-catalyst sensors. Such sensors may be oxygen (e.g., $O_2$) sensors and/or any other type of sensor. At block 420, data may be received at an emissions control module from one or more mid-catalyst sensors. Such sensors may be oxygen (e.g., $O_2$) sensors and/or any other type of sensor. At block 430, data may be received at an emissions control module from one or more post-catalyst sensors. Such sensors may be oxygen (e.g., $O_2$) sensors, NOx sensors, CO sensors, and/or any other type of sensor. Note that in an alternate embodiment, no mid-catalyst sensors may be present, and therefore the functions of block 420 may be omitted. It is contemplated that any number of sensors of any type may be used, and such sensors may be located at any location within an engine and catalyst system.

At block 440, an emissions control module may make a determination, based on the data received from one or more sensors, of an appropriate air-fuel ratio. In many embodiments, this determination may be the selection of an air-fuel ratio that maintains or brings the emissions levels of an engine below predetermined levels, such as those mandated by the EPA. At block 440, the emissions control module may instruct or otherwise cause one or more air-fuel regulators to implement the determined air-fuel ratio; i.e., operate the engine using the determined air-fuel ratio.

The technical effect of the systems and methods set forth herein is the ability to more efficiently control the air-fuel mixture used in an engine, and thereby more efficiently ensure that emissions of the engine are kept at desired levels. As will be appreciated by those skilled in the art, the use of the disclosed processes and systems may reduce the emissions of such engines to low levels and maintain those emissions at low levels without requiring manual intervention. Those skilled in the art will recognize that the disclosed systems and methods may be combined with other systems and technologies in order to achieve even greater emissions control and engine performance. All such embodiments are contemplated as within the scope of the present disclosure.

Figure 5:
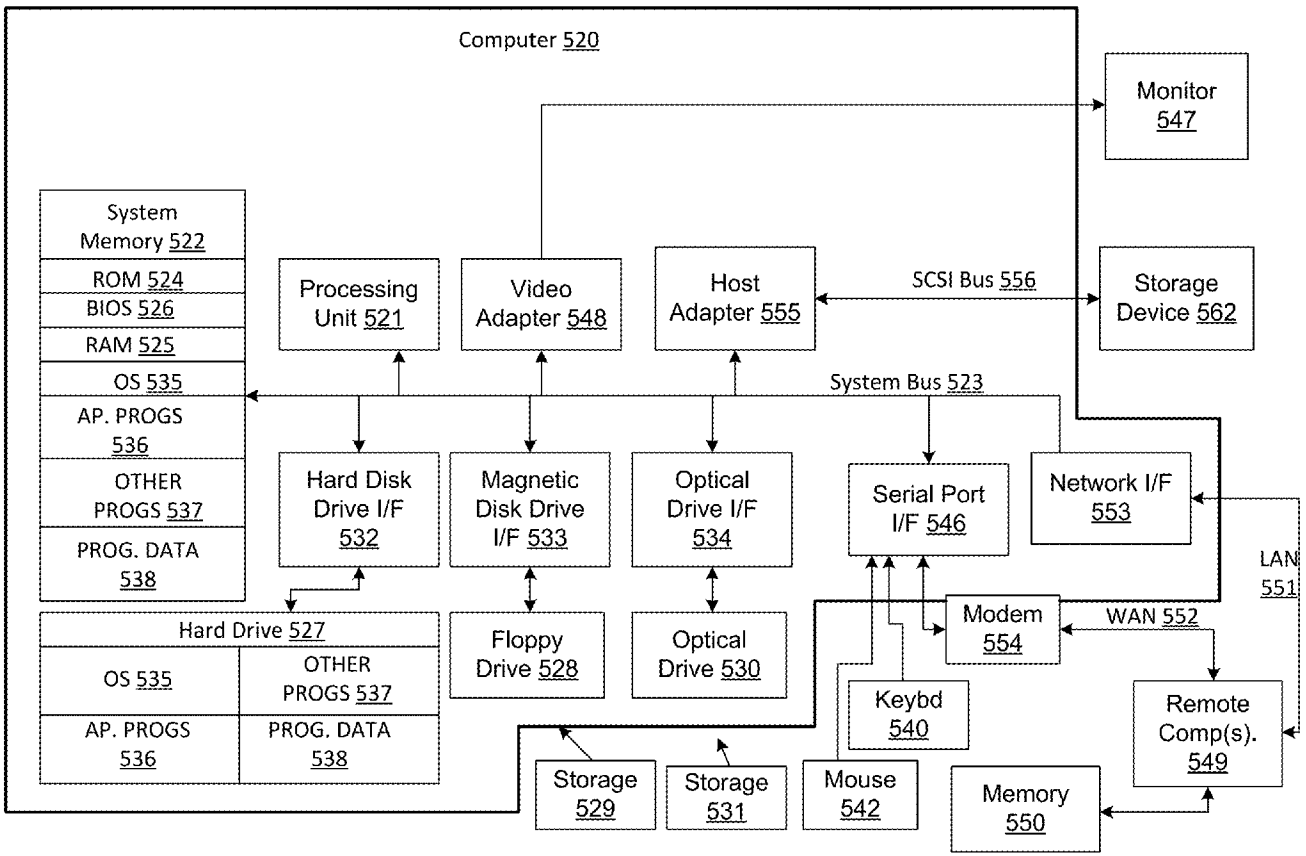
FIG. 5 is an exemplary block diagram representing a general purpose computer system in which aspects of the methods and systems disclosed herein may be incorporated.

FIG. 5 and the following discussion are intended to provide a brief general description of a suitable computing environment in which the methods and systems disclosed herein and/or portions thereof may be implemented. For example, the functions of emissions control modules 230 and 330 may be performed by one or more devices that include some or all of the aspects described in regard to FIG. 5. Some or all of the devices described in FIG. 5 that may be used to perform functions of the claimed embodiments may be configured in a controller that may be embedded into a system such as those described with regard to FIGS. 2 and 3. Alternatively, some or all of the devices described in FIG. 5 may be included in any device, combination of devices, or any system that performs any aspect of a disclosed embodiment.

Although not required, the methods and systems disclosed herein may be described in the general context of computer-executable instructions, such as program modules, being executed by a computer, such as a client workstation, server or personal computer. Such computer-executable instructions may be stored on any type of computer-readable storage device that is not a transient signal per se. Generally, program modules include routines, programs, objects, components, data structures and the like that perform particular tasks or implement particular abstract data types. Moreover, it should be appreciated that the methods and systems disclosed herein and/or portions thereof may be practiced with other computer system configurations, including hand-held devices, multiprocessor systems, microprocessor-based or programmable consumer electronics, network PCs, minicomputers, mainframe computers and the like. The methods and systems disclosed herein may also be practiced in distributed computing environments where tasks are performed by remote processing devices that are linked through a communications network. In a distributed computing environment, program modules may be located in both local and remote memory storage devices.

FIG. 5 is a block diagram representing a general purpose computer system in which aspects of the methods and systems disclosed herein and/or portions thereof may be incorporated. As shown, the exemplary general purpose computing system includes computer 520 or the like, including processing unit 521, system memory 522, and system bus 523 that couples various system components including the system memory to processing unit 521. System bus 523 may be any of several types of bus structures including a memory bus or memory controller, a peripheral bus, and a local bus using any of a variety of bus architectures. The system memory may include read-only memory (ROM) 524 and random access memory (RAM) 525. Basic input/output system 526 (BIOS), which may contain the basic routines that help to transfer information between elements within computer 520, such as during start-up, may be stored in ROM 524.

Computer 520 may further include hard disk drive 527 for reading from and writing to a hard disk (not shown), magnetic disk drive 528 for reading from or writing to removable magnetic disk 529, and/or optical disk drive 530 for reading from or writing to removable optical disk 531 such as a CD-ROM or other optical media. Hard disk drive 527, magnetic disk drive 528, and optical disk drive 530 may be connected to system bus 523 by hard disk drive interface 532, magnetic disk drive interface 533, and optical drive interface 534, respectively. The drives and their associated computer-readable media provide non-volatile storage of computer readable instructions, data structures, program modules and other data for computer 520.

Although the exemplary environment described herein employs a hard disk, removable magnetic disk 529, and removable optical disk 531, it should be appreciated that other types of computer readable media that can store data that is accessible by a computer may also be used in the exemplary operating environment. Such other types of media include, but are not limited to, a magnetic cassette, a flash memory card, a digital video or versatile disk, a Bernoulli cartridge, a random access memory (RAM), a read-only memory (ROM), and the like.

A number of program modules may be stored on hard disk drive 527, magnetic disk 529, optical disk 531, ROM 524, and/or RAM 525, including an operating system 535, one or more application programs 536, other program modules 537 and program data 538. A user may enter commands and information into the computer 520 through input devices such as a keyboard 540 and pointing device 542. Other input devices (not shown) may include a microphone, joystick, game pad, satellite disk, scanner, or the like. These and other input devices are often connected to the processing unit 521 through a serial port interface 546 that is coupled to the system bus, but may be connected by other interfaces, such as a parallel port, game port, or universal serial bus (USB). A monitor 547 or other type of display device may also be connected to the system bus 523 via an interface, such as a video adapter 548. In addition to the monitor 547, a computer may include other peripheral output devices (not shown), such as speakers and printers. The exemplary system of FIG. 5 may also include host adapter 555, Small Computer System Interface (SCSI) bus 556, and external storage device 562 that may be connected to the SCSI bus 556.

The computer 520 may operate in a networked environment using logical and/or physical connections to one or more remote computers or devices, such as remote computer 549, air-fuel regulators 241, 242, 341, and/or 342. Each of air-fuel regulators 241, 242, 341, and/or 342 may be any device as described herein capable of performing the regulation of air and/or fuel entering an engine. Remote computer 549 may be a personal computer, a server, a router, a network PC, a peer device or other common network node, and may include many or all of the elements described above relative to the computer 520, although only a memory storage device 550 has been illustrated in FIG. 5. The logical connections depicted in FIG. 5 may include local area network (LAN) 551 and wide area network (WAN) 552. Such networking environments are commonplace in offices, enterprise-wide computer networks, intranets, and the Internet.

When used in a LAN networking environment, computer 520 may be connected to LAN 551 through network interface or adapter 553. When used in a WAN networking environment, computer 520 may include modem 554 or other means for establishing communications over wide area network 552, such as the Internet. Modem 554, which may be internal or external, may be connected to system bus 523 via serial port interface 546. In a networked environment, program modules depicted relative to computer 520, or portions thereof, may be stored in a remote memory storage device. It will be appreciated that the network connections shown are exemplary and other means of establishing a communications link between computers may be used.

Computer 520 may include a variety of computer-readable storage media. Computer-readable storage media can be any available tangible media that can be accessed by computer 520 and includes both volatile and nonvolatile media, removable and non-removable media. By way of example, and not limitation, computer-readable media may comprise computer storage media and communication media. Computer storage media include volatile and nonvolatile, removable and non-removable media implemented in any method or technology for storage of information such as computer readable instructions, data structures, program modules or other data. Computer storage media include, but are not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other tangible medium which can be used to store the desired information and which can be accessed by computer 520. Combinations of any of the above should also be included within the scope of computer-readable media that may be used to store source code for implementing the methods and systems described herein. Any combination of the features or elements disclosed herein may be used in one or more embodiments.

This written description uses examples to disclose the subject matter contained herein, including the best mode, and also to enable any person skilled in the art to practice the invention, including making and using any devices or systems and performing any incorporated methods. The patentable scope of this disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A system comprising:

a catalyst;

a first oxygen sensor configured to detect oxygen content of gases entering the catalyst and to report the oxygen content of the gases entering the catalyst to an emissions control module;

a second oxygen sensor disposed within a catalyst brick of the catalyst and configured to detect oxygen content of the gases within the catalyst and to report the oxygen content of the gases within the catalyst to the emissions control module;

a third oxygen sensor configured to detect oxygen content of gases exiting the catalyst and to report the oxygen content of the gases exiting the catalyst to the emissions control module;

a carbon monoxide sensor configured to detect carbon monoxide content of gases exiting the catalyst and to report the carbon monoxide content of the gases exiting the catalyst to the emissions control module; and the emissions control module comprises a memory and a processor, wherein the processor is configured to access and execute one or more routines encoded by the memory that when executed determine an air-fuel ratio based on the oxygen content of the gases entering the catalyst, the oxygen content of the gases within the catalyst, and both the oxygen content and the carbon monoxide content of the gases exiting the catalyst, and to control an air-fuel regulator to operate an engine at the air-fuel ratio.

2. The system of claim 1, comprising a $NO_x$ sensor configured to detect a $NO_x$ content of gases exiting the catalyst and to report the NOx content of the gases exiting the catalyst to the emissions control module.

3. The system of claim 1, wherein the catalyst is configured in a rich burn engine.

4. The system of claim 1, wherein the air-fuel regulator comprises at least one of a fuel system, a fuel valve, a fuel pass regulator, a carburetor, or a fuel injector.

5. The system of claim 1, wherein the emissions control module being configured to determine the air-fuel ratio comprises the emissions control module being configured to determine the air-fuel ratio by determining a first air-fuel ratio based on the oxygen content of the gases entering the catalyst and to determine a second air-fuel ratio by modifying the first air-fuel ratio based on both the oxygen content and the carbon monoxide content of the gases exiting the catalyst; and wherein the emissions control module being configured to instruct the air-fuel regulator to operate the engine using the air-fuel ratio comprises the emissions control module being configured to instruct the air-fuel regulator to operate the engine using the second air-fuel ratio.

6. The system of claim 1, wherein the emissions control module comprises a post-catalyst $O_2$ set-point, and wherein the emissions control module is further configured to determine the air-fuel ratio based on the post-catalyst $O_2$ set-point.

7. The system of claim 1, wherein the emissions control module is further configured to transmit a notification upon determining a carbon monoxide level has met a predetermined carbon monoxide threshold.

8. A system comprising:

a catalyst;

a first oxygen sensor configured to detect oxygen content of gases entering the catalyst and to report the oxygen content of the gases entering the catalyst to an emissions control module;

a second oxygen sensor configured to detect oxygen content of gases exiting the catalyst and to report the oxygen content of the gases exiting the catalyst to the emissions control module;

a $NO_x$ sensor configured to detect a $NO_x$ content of gases exiting the catalyst and to report the $NO_x$ content of the gases exiting the catalyst to the emissions control module; and the emissions control module comprises a memory and a processor, wherein the processor is configured to access and execute one or more routines encoded by the memory that when executed determine an air-fuel ratio based on the oxygen content of the gases entering the catalyst and the oxygen content of the gases exiting the catalyst, to control an air-fuel regulator to operate an engine at the air-fuel ratio, to adjust the air-fuel ratio utilizing a post-catalyst $O_2$ set-point bias table, to determine an initial post-catalyst on the $NO_x$ content of the gases exiting the catalyst and to load the initial post-catalyst $O_2$ set-point into the post-catalyst $O_2$ set-point bias table.

9. The system of claim 8, wherein the emissions control module is configured to modify the post-catalyst $O_2$ set-point bias table as the $NO_x$ content of the gases exiting the catalyst change.

10. The system of claim 8, wherein the emissions control module is configured to determine a catalyst operating window and to set a determined air-fuel ratio set-point as a zero (0) bias point.

11. The system of claim 8, comprising a third oxygen sensor disposed within a catalyst brick of the catalyst and configured to detect oxygen content of the gases within the catalyst and to report the oxygen content of the gases within the catalyst to the emissions control module, wherein the emissions control module is configured to determine the air-fuel ratio based on the oxygen content of the gases entering the catalyst, the oxygen content of the gases within the catalyst, and the oxygen content of the gases exiting the catalyst.

12. A method comprising:

receiving, at an emissions control module from a first oxygen sensor, data indicating oxygen content of gases entering a catalyst, wherein the emissions control module comprises a memory and a processor;

receiving, at the emissions control module from a second oxygen sensor, data indicating oxygen content of gases exiting the catalyst;

receiving, at the emissions control module from a $NO_x$ sensor, data indicating $NO_x$ content of gases exiting the catalyst;

determining, at the emissions control module, an air-fuel ratio based on the oxygen content of the gases entering the catalyst and the oxygen content of the gases exiting the catalyst;

controlling an air-fuel regulator to operate an engine at the air-fuel ratio;

adjusting, at the emissions control module, the air-fuel ratio utilizing a post-catalyst $O_2$ set-point bias table;

determining, at the emissions control module, an initial post-catalyst $O_2$ set-point based on the $NO_x$ content of the gases exiting the catalyst; and loading, at the emissions control module, the initial post-catalyst $O_2$ set-point into the post-catalyst $O_2$ set-point bias table.

* * * * *

UNITED STATES PATENT AND TRADEMARK OFFICE

CERTIFICATE OF CORRECTION

PATENT NO. : 8,887,490 B2
APPLICATION NO. : 13/760630
DATED : November 18, 2014
INVENTOR(S) : Wentz et al.

It is certified that error appears in the above-identified patent and that said Letters Patent is hereby corrected as shown below:

In Column 10, Line 50, in Claim 8, delete "on the $NO_x$" and insert -- $O_2$ set-point based on the $NO_x$ --, therefor.

Signed and Sealed this
Seventh Day of June, 2016

Michelle K. Lee

Michelle K. Lee
*Director of the United States Patent and Trademark Office*